US008151502B2

(12) United States Patent
Waltersdorf

(10) Patent No.: US 8,151,502 B2
(45) Date of Patent: Apr. 10, 2012

(54) WRISTBAND TAG

(75) Inventor: Bryan M. Waltersdorf, Oconomowoc, WI (US)

(73) Assignee: Artemax, Inc., Brookfield, WI (US)

( * ) Notice: Subject to any disclaimer, the term of this patent is extended or adjusted under 35 U.S.C. 154(b) by 4 days.

(21) Appl. No.: 12/410,036

(22) Filed: Mar. 24, 2009

(65) Prior Publication Data

US 2010/0242325 A1 Sep. 30, 2010

(51) Int. Cl.
*A44C 5/00* (2006.01)

(52) U.S. Cl. ..... 40/633

(58) Field of Classification Search ..... 40/633
See application file for complete search history.

(56) References Cited

U.S. PATENT DOCUMENTS

| | | | | |
|---|---|---|---|---|
| 6,000,160 | A * | 12/1999 | Riley | 40/633 |
| 2005/0108912 | A1 * | 5/2005 | Bekker | 40/633 |
| 2006/0242875 | A1 * | 11/2006 | Wilson et al. | 40/633 |
| 2009/0094872 | A1 | 4/2009 | Ali et al. | |

* cited by examiner

*Primary Examiner* — Joanne Silbermann
*Assistant Examiner* — Shin Kim
(74) *Attorney, Agent, or Firm* — Michael Best & Friedrich LLP

(57) ABSTRACT

A wristband tag strip comprises a border portion, a tag portion having a perimeter, and a cut portion between the border portion and the tag portion to define at least a portion of the perimeter. The cut portion includes a kiss-cut portion and a through-cut portion. In one embodiment, the perimeter comprises at least two corner sections separating at least two side sections, wherein through-cut portions define the at least two corner sections and kiss-cut portions define the at least two side sections. Preferably, the through-cut portion has a length that is at least 2% (e.g., at least 3%, 4%, or 5%) of a length of the perimeter. Also, the kiss-cut portion preferably has a thickness that is less than 25% (e.g., less than 15%, 10%, or 5%) of the thickness of the tag portion.

19 Claims, 3 Drawing Sheets

WRISTBAND TAG

BACKGROUND

The present invention generally relates to wristbands, and specifically to wristband tags that are attached to a wristband straps and provide a surface for imprinting indicia.

Wristbands are commonly used as a means for identifying an individual. For example, wristbands can be used to identify individuals that are authorized to be in a certain location (e.g., at a concert or a park) or to consume certain food or beverages (e.g., at a party), such as alcoholic beverages. Wristbands are commonly of a certain color or imprinted pattern to facilitate visual identification at a distance.

Wristbands are also commonly used as a means for identifying specific individuals. For example, in a hospital, it is important to identify patients by name or other characteristics to insure that the patient is obtaining the appropriate medical care. Wristbands are commonly used in hospitals to identify a patient by name, date of birth, or other information.

In order to facilitate the addition of information to a wristband (e.g., in a hospital setting), wristbands have been designed to pass through a printer so that the user's information can be entered into a computer and then easily printed on the wristband. These wristbands can be provided to the printer on a roll, with each wristband being connected to an adjacent wristband at a perforated edge.

In order to increase the surface area of a wristband that receives information, it is known to use wristband tags that can be coupled to a wristband strap. For example, published U.S. Patent Application 2006/0242875 discloses a wristband tag that is wider than a typical wristband and includes slots through which a wristband strap can be threaded. The tags are formed on a carrier (e.g., a strip or roll) that can be fed through a printer. The tags can be defined by a perforation cut around the periphery of the tag, which facilitates separating the tags from a border. A wristband strap can then be threaded through the slots of the tag and secured to the user's wrist. The entire contents of published U.S. Patent Application 2006/0242875 is hereby incorporated by reference.

SUMMARY OF THE INVENTION

After being separated from the border, the peripheral edge of the above-described tag will have the remnants of the perforation cut that separated the tag from the border. That is, the peripheral edge of the tag will have the series of small bumps or nubs. After the tag is secured to the user's wrist, these bumps or nubs will be in contact with the user's skin, which can cause discomfort to the user, especially if there is any significant movement between the tag and the user's skin. This can be particularly problematic when the user has sensitive skin, such as might be the case when the user is an infant or an elderly person.

Further, when the tag is separated from the border by a perforation, separation of the tag from the border can be difficult. That is, in order to separate the tag from the border, one must first break through the perforation, which commonly requires repeated bending of the perforation until it easily tears.

The present invention solves the above-noted problems by reducing or eliminating the bumps or nubs that are created when a tag is separated from a border along a perforation, and further by allowing better engagement of the tag by the user to facilitate separation of the tag from the border. More specifically, instead of creating a perforation between the tag and the border, the present invention utilizes a kiss-cut around a first portion of the periphery of the tag and a through-cut around a second portion of the periphery of the tag. The result is a wristband tag strip comprising a border portion (e.g., around the entire perimeter of the tag portion), a tag portion (e.g., a plurality of tag portions) having a perimeter, and a cut portion between the border portion and the tag portion to define at least a portion of the perimeter. The cut portion includes a kiss-cut portion (e.g., defining a side section of the perimeter) and a through-cut portion (e.g., defining a corner section of the perimeter).

In one embodiment, the perimeter comprises at least two corner sections (e.g., four corner sections) separating at least two side sections (e.g., four side sections), wherein through-cut portions define the two corner sections and kiss-cut portions define the two side sections. Preferably, each through-cut portion has a length that is at least 2% (e.g., at least 3%, 4%, or 5%) and preferably about 6% of a length of the perimeter. The through-cut portions preferably cumulatively have a length that is less than about 50% (e.g., less than 40%, 30%, or 25%) and preferably about 22% of the length of the perimeter. Also, the kiss-cut portion preferably has a thickness that is less than 25% (e.g., less than 15%, 10%, or 5%) of the thickness of the tag portion.

The above-described wristband tag strip can be made according the method of providing a blank strip and creating a cut portion in the blank strip to define tag portion and a border portion. The step of creating a cut portion includes cutting a through-cut in the blank strip to define a first portion (e.g., a corner section) of a perimeter of the tag portion, and cutting a kiss-cut in the strip to define a second portion (e.g., a side section) of the perimeter of the tag portion.

DETAILED DESCRIPTION

Figure 1:
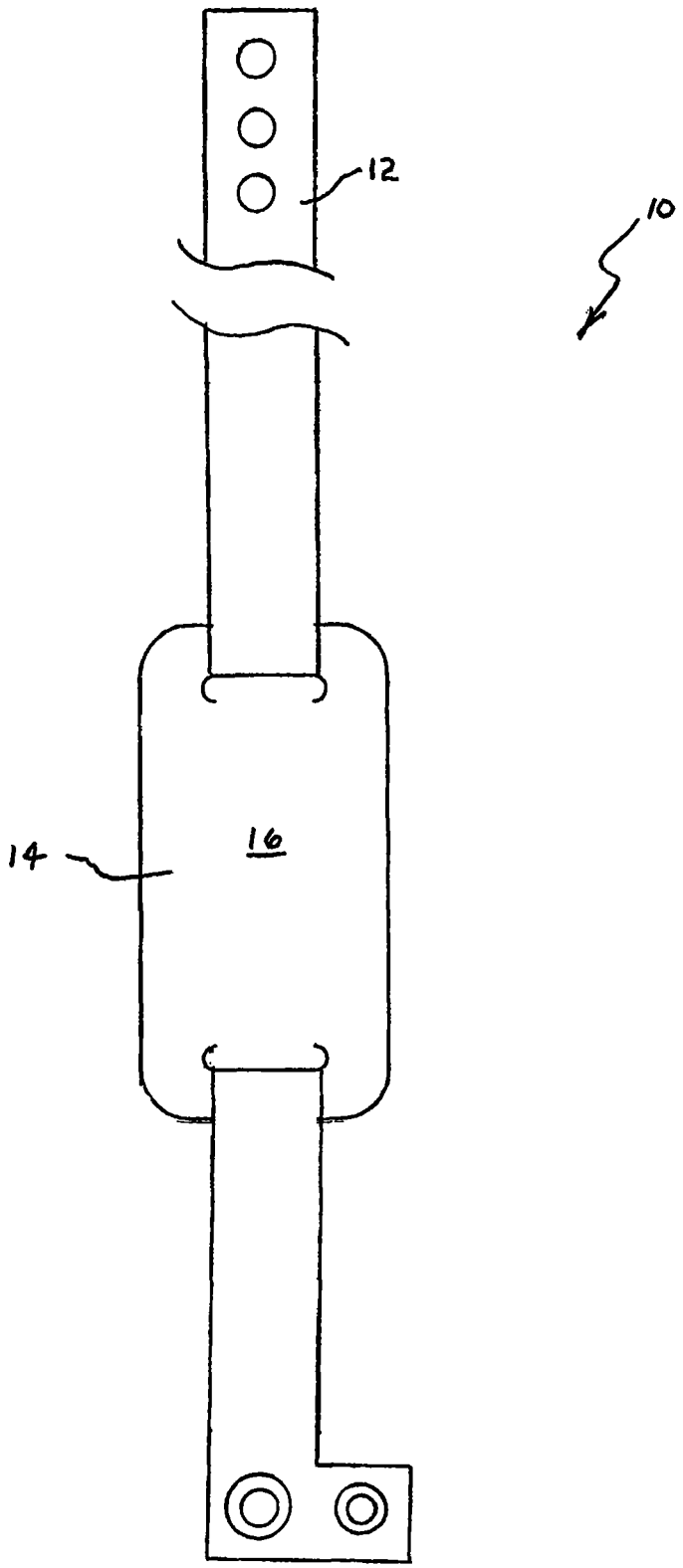
FIG. 1 illustrates a wristband assembly having a wristband tag mounted on a wristband strap.

FIG. 1 illustrates a wristband assembly 10 including a wristband strap 12 and a wristband tag 14. The strap 12 is designed to wrap around and secure to an item or person (e.g., a person's wrist or ankle), as is known in the art. The tag 14 is designed to have information printed on its surface 16, such as product identification or a user's name.

Figure 2:
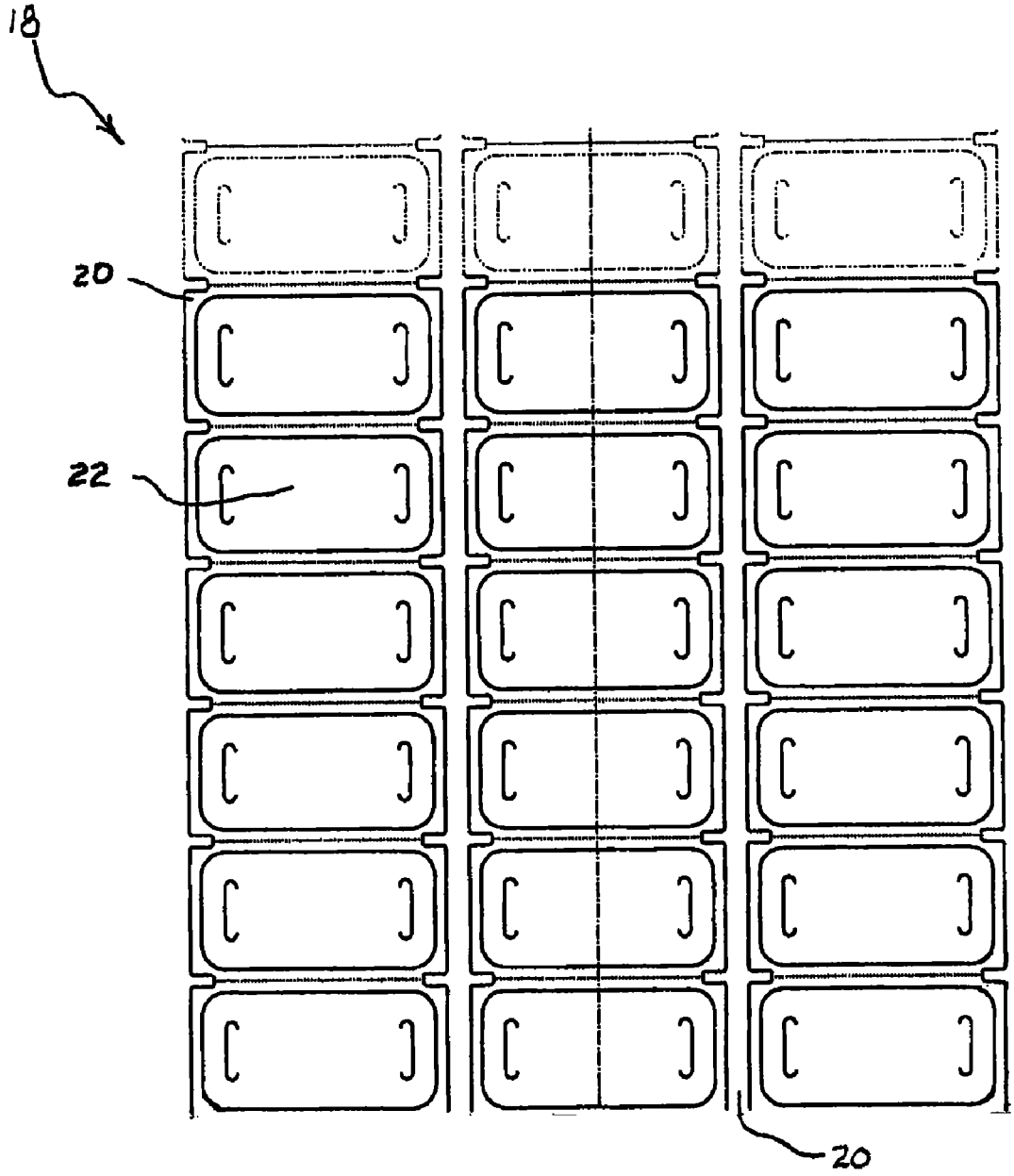
FIG. 2 illustrates wristband tag strip that includes a plurality of wristband tags mounted within a border.

In order to facilitate the application of information on the tag, tags are commonly provided on carrier 18 in the form of a sheet or strip, as shown in FIG. 2, that can be fed into a printer. The carrier 18 includes a border portion 20 and a plurality of tag portions 22. The carrier 18 can be made from any suitable sheet material, such as paper, plastic, rubber, and the like.

Figure 3:
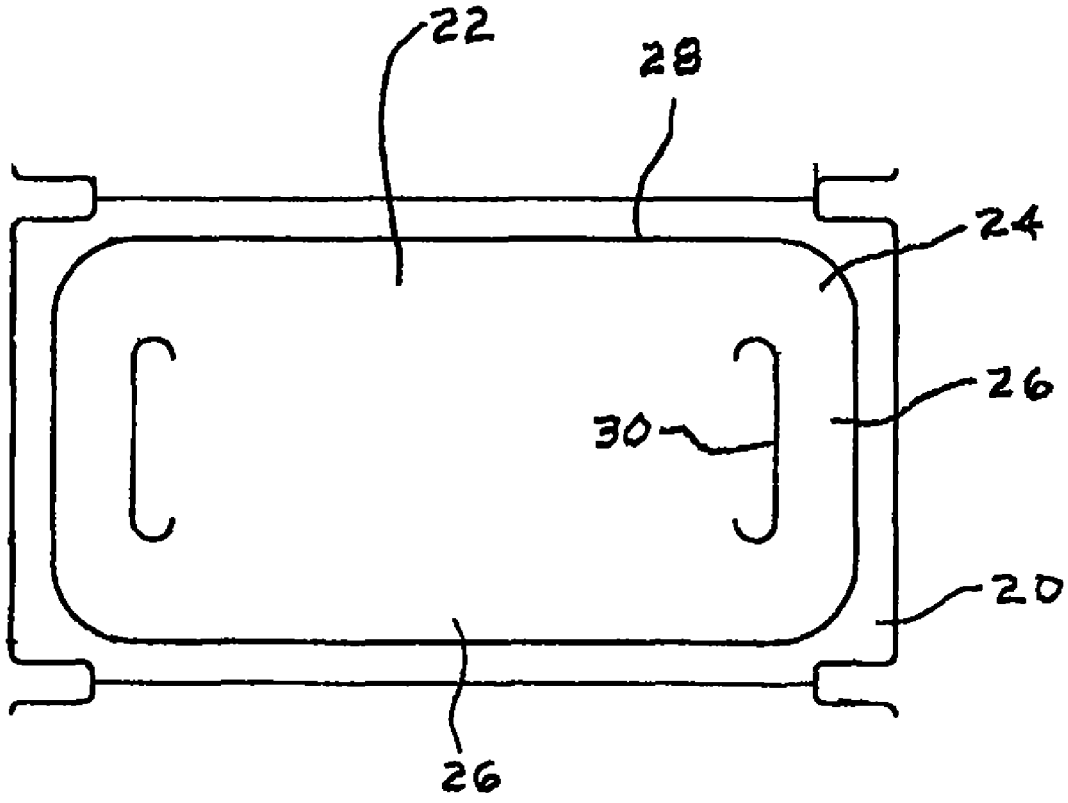
FIG. 3 illustrates a single tag from the strip of FIG. 2.

Referring to FIG. 3, each tag portion 22 is generally rectangular in shape, and thus includes four corners 24 and four sides 26. Each tag portion 22 is separated from the border portion 20 by a cut portion 28 in the form of a die cut around the perimeter of the tag portion 22. In the illustrated embodiment, the die cut at the four corners of the tag portion is a through-cut (complete cut that goes all the way through the material). In the illustrated embodiment, the perimeter of each tag portion 22 is about 180 mm, and each through-cut corner is about 10 mm long. As a result, each corner 24 is about 5.6% of the overall length of the perimeter of each tag portion 22, and the corners 24 cumulatively have a length that is about 22% of the overall length of the perimeter of each tag portion 22

The die cut along the four sides 26 of the tag portion 22 is a kiss-cut (e.g., a partial cut that cuts only partially through the material). In the illustrated embodiment, the kiss cut extends approximately 95% through the thickness of the material. Each short side is about 19 mm long, and each long side is about 51 mm long. As a result, each corner 24 is about 53% of the length of each short side and about 20% of the length of each long side.

Each tag portion 22 includes two C-shaped slots 30 that are created by a die cut all the way through the material. These slots 30 can be formed during the same die cutting operation that forms the periphery of the tag portion, or in a separate operation. The slots 30 are dimensioned to receive a wristband strap 12, as illustrated in FIG. 1.

The die cut around the periphery of the tag portion 22 facilitates the separation of the tag portion 22 from the border portion 20. By virtue of the use of a kiss-cut along the sides of the tag portion 22, the separation of the tag portion 22 from the border portion 20 creates a smooth edge on the periphery of the tag portion 22. Furthermore, by virtue of the fact that the corners 24 of the tag portion 22 are formed by a through-cut, the corners 24 of the tag portion 22 can be easily separated from the adjacent border portion 20 to make it easier to grab the corner 24 of the tag portion 22 in preparation for tearing it away from the border portion 20.

The invention claimed is:

1. A wristband tag strip comprising:

a border portion;

a tag portion having a perimeter; and a cut portion between the border portion and the tag portion and defining at least a portion of the perimeter, the cut portion including a kiss-cut portion and a through-cut portion.

2. A wristband tag strip as claimed in claim 1, wherein the border portion wraps around the entire perimeter of the tag portion.

3. A wristband tag strip as claimed in claim 1, wherein the tag portion comprises at least two tag portions.

4. A wristband tag strip as claimed in claim 1, wherein the perimeter comprises a corner section and a side section, and wherein the through-cut portion defines the corner section and the kiss-cut portion defines the side section.

5. A wristband tag strip as claimed in claim 1, wherein the perimeter comprises at least two corner sections separating at least two side sections, and wherein the through-cut portions define the at least two corner sections and kiss-cut portions define the at least two side sections.

6. A wristband tag strip as claimed in claim 1, wherein the perimeter comprises at least four corner sections separating at least four side sections, and wherein the through-cut portions define the at least four corner sections and kiss-cut portion define the at least four side sections.

7. A wristband tag strip as claimed in claim 1, wherein the through-cut portion has a length that is at least 2% of a length of the perimeter.

8. A wristband tag strip as claimed in claim 1, wherein the through-cut portion has a length that is at least 5% of a length of the perimeter.

9. A wristband tag strip as claimed in claim 1, wherein the kiss-cut portion has a thickness that is less than 25% of the thickness of the tag portion.

10. A wristband tag strip as claimed in claim 1, wherein the kiss-cut portion has a thickness that is less than 15% of the thickness of the tag portion.

11. A wristband tag strip as claimed in claim 1, wherein the kiss-cut portion has a thickness that is less than 10% of the thickness of the tag portion.

12. A wristband tag strip as claimed in claim 1, wherein the tag portion further includes an opening adapted to receive a strap, and wherein the opening comprises a C-shaped slot.

13. A method of creating a wristband tag strip comprising:

providing a blank strip;

creating a cut portion in the blank strip to define tag portion and a border portion, wherein creating a cut portion includes:

cutting a through-cut in the blank strip to define a first portion of a perimeter of the tag portion; and cutting a kiss-cut in the strip to define a second portion of the perimeter of the tag portion.

14. A method as claimed in claim 13, wherein through-cut portion defines a corner section of the tag portion and the kiss-cut portion defines a side section of the tag portion.

15. A method as claimed in claim 13, wherein the through-cut portion has a length that is at least 2% of a length of the perimeter.

16. A method as claimed in claim 13, wherein the through-cut portion has a length that is at least 5% of a length of the kiss-cut portion.

17. A method as claimed in claim 13, wherein the kiss-cut portion has a thickness that is less than 25% of the thickness of the tag portion.

18. A method as claimed in claim 13, wherein the kiss-cut portion has a thickness that is less than 15% of the thickness of the tag portion.

19. A method as claimed in claim 13, wherein the kiss-cut portion has a thickness that is less than 10% of the thickness of the tag portion.

* * * * *